US007632056B2

(12) United States Patent
Nilsson

(10) Patent No.: US 7,632,056 B2
(45) Date of Patent: Dec. 15, 2009

(54) DEVICE FOR ATTACHING A LOADER TO A VEHICLE

(75) Inventor: Tommy Nilsson, Umeå (SE)

(73) Assignee: Ålö AB, Umeå (SE)

( * ) Notice: Subject to any disclaimer, the term of this patent is extended or adjusted under 35 U.S.C. 154(b) by 263 days.

(21) Appl. No.: 10/570,792

(22) PCT Filed: Sep. 7, 2004

(86) PCT No.: PCT/SE2004/001282

§ 371 (c)(1),
(2), (4) Date: Sep. 25, 2006

(87) PCT Pub. No.: WO2005/024142

PCT Pub. Date: Mar. 17, 2005

(65) Prior Publication Data

US 2007/0059147 A1 Mar. 15, 2007

(30) Foreign Application Priority Data

Sep. 9, 2003 (SE) ..... 0302413

(51) Int. Cl.
*E02F 9/00* (2006.01)

(52) U.S. Cl. ..... 414/723; 37/468; 403/327

(58) Field of Classification Search ..... 414/686, 414/723; 37/468; 403/327, 325, 324
See application file for complete search history.

(56) References Cited

U.S. PATENT DOCUMENTS 3,220,487 A 11/1965 Pilch
3,805,980 A 4/1974 Kisaka
5,540,289 A * 7/1996 Hirooka et al. ..... 172/274
6,530,741 B1 * 3/2003 Kourogi et al. ..... 414/686
2004/0067126 A1 * 4/2004 Schmidt ..... 414/723

FOREIGN PATENT DOCUMENTS

| | | |
|---|---|---|
| EP | 0 178 556 | 4/1986 |
| ES | 2 013 014 | 4/1990 |
| FR | 2 208 372 | 6/1974 |

OTHER PUBLICATIONS

International Search Report for PCT/SE2004/001282 dated Dec. 6, 2004.

* cited by examiner

*Primary Examiner*—Donald Underwood
(74) *Attorney, Agent, or Firm*—Nixon & Vanderhye P.C.

(57) ABSTRACT

This invention concerns a device (1) for attaching a loader (2) to a vehicle (3), usually a tractor, where the loader (2) comprises openings (4) in parts (6) facing the vehicle (3) and the vehicle (3) comprises openings (5) in attaching parts (7) facing the loader (2) and where the openings (4, 5) when attaching are arranged so that the centre point P of each opening lies on an axis common to all the openings (4, 5). The device is characterised in a fixed part (8) arranged on the outside (6*a*) of the loader, a moving part (9) that can move in relation to the fixed part (8) and which is protected, controlled and directed by the fixed part (8) and an influencing part (16) that conveys a force (F) to the moving part (9) so that it strives to attain a locking position and where the moving part (9) when attaching moves from an open position where there is no locking action between the loader and the tractor to an intermediate position where the continued locking motion of the moving part (9) can be activated by the tractor, whereby the influencing part (16) is activated and the moving part (9) is moved further to a locking position at which the moving part (9) is arranged in the openings (4, 5) and through interaction with them locks the loader (2) to the tractor (3) and is kept in its locking position by force (F) from the influencing part (16).

18 Claims, 6 Drawing Sheets

Section A-A

Section B-B

Section C-C

DEVICE FOR ATTACHING A LOADER TO A VEHICLE

This application is the US national phase of international application PCT/SE2004/001282 filed 7 Sep. 2004, which designated the U.S. and claims priority to SE 0302413-0 filed 9 Sep. 2003, the entire contents of each of which are hereby incorporated by reference.

This invention concerns a device for attaching a loader to a vehicle, usually a tractor.

Vehicles, usually tractors for various types of work, for example lifting, are previously known. Tractors usually comprises a structure, for example a mounting, fastening iron, brackets or the like, to which an arm construction, normally called a loader, is mounted. This part will henceforth be called the mounting.

The loader is a long elongated construction comprising two parallel arm sections comprising joint arrangements. The loader has on one end, the end pointing away from the tractor, a fastening device allowing a tool to be fastened to the far end of the loader. On the other end of the loader, the end closest to the tractor, are two parts arranged, parallel to each other and terminating the arm sections, to which cylinders and other arm parts can be attached. These parts will henceforth be called bearing boxes. Each bearing box is mounted on, joined to, the tractor. The mounting on the tractor offers two attachments on which the two bearing boxes are mounted.

It is previously known to mount and secure a loader on a tractor through the use of attachments being inserted into/through parallel/axial holes arranged both in the tractor, in the attaching parts of the tractor mounting, and in the loader, in the bearing boxes on the loader. At the time of an attachment, the holes are arranged so that the centre point of each one is on a common axis. These attachments are usually mounted by one person standing to the side, the outside, of the loader and the tractor. The attachment, which is usually an elongated locking pin separate from the tractor and loader, usually with a handle on one end, is inserted into the holes, placed in accordance with the common axis, from the outside of the loader and tractor, whereby a cotter type of locking of the loader in relation to the tractor is obtained.

These types of locking pins are separate from both the tractor and the loader and can easily be mislaid and therefore missing when assembly is to take place. The attachment of a loader to a tractor with the help of separate units in the form of locking pins is time-consuming and not particularly easy to perform.

One object of the invention is to offer a device that allows fast, simple and reliable attachment of a loader to a vehicle.

This object is achieved with a device for attaching a loader to a vehicle, wherein the loader comprises openings in parts facing towards the vehicle and the vehicle comprises openings in attaching parts facing the loader, and wherein the openings when attaching are arranged so that the centre points of the openings lie on an axis common to all the openings, the device comprising a fixed part arrangeable on the outside of the loader, a moving part that can move in relation to the fixed part and which is protected, controlled and directed by the fixed part, and an influencing part to convey a force to the moving part so that it strives to attain a locking position, wherein the moving part when attaching moves from an open position where there is no locking action between the loader and the vehicle to an intermediate position where the continued locking motion of the moving part can be activated by the vehicle, whereby the influencing part is activated and the moving part is moved further to a locking position at which the moving part is arrangeable in the openings and through interaction with them enables locking of the loader to the vehicle and is kept in its locking position by the force from the influencing part.

The invention will be described below based on one embodiment with references made to the figures. Additional advantages and finesses of the invention will also be described.

Figure 1:
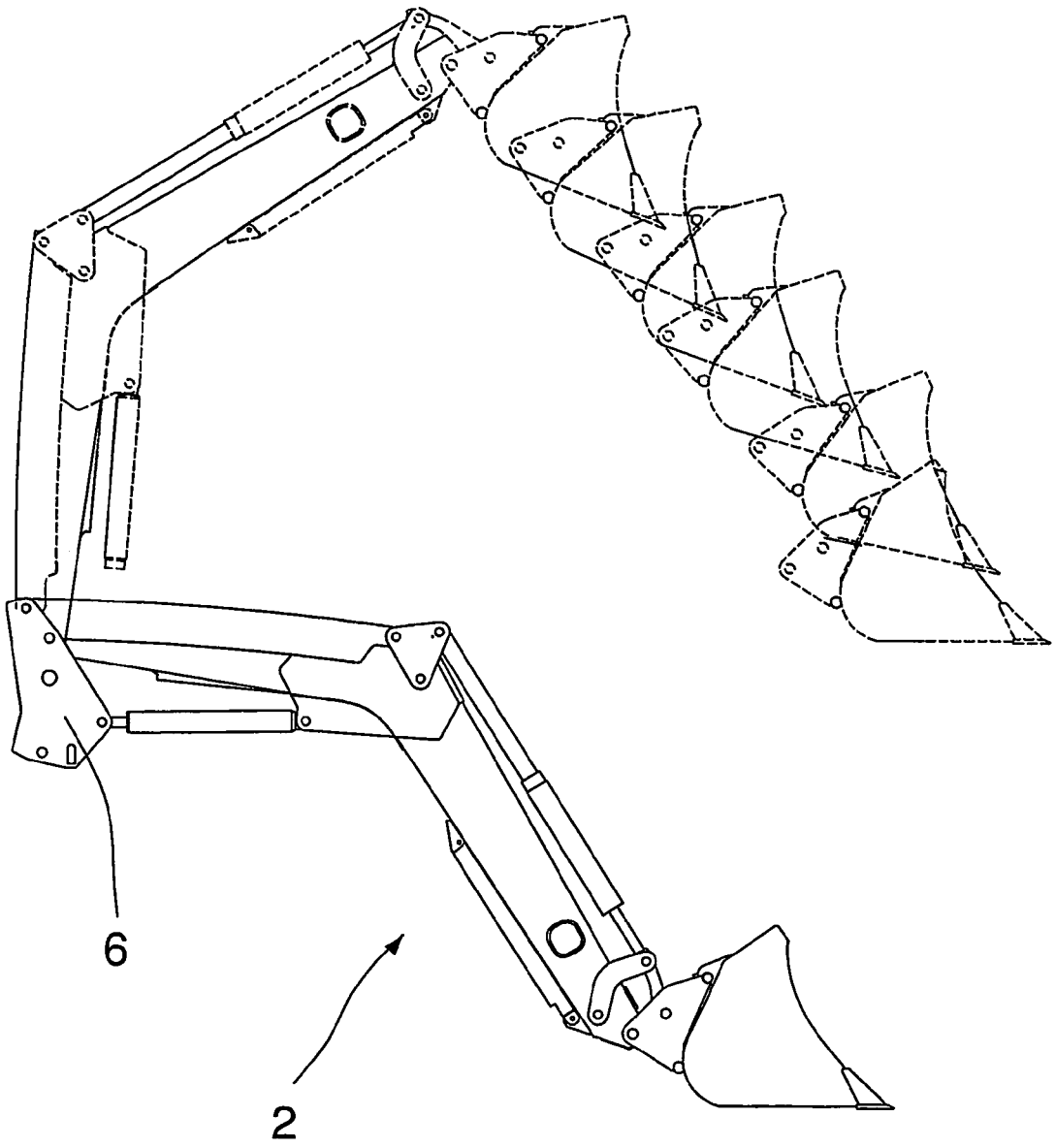
FIG. 1 shows a previously known loader with attachment, a bucket.
Figure 2:
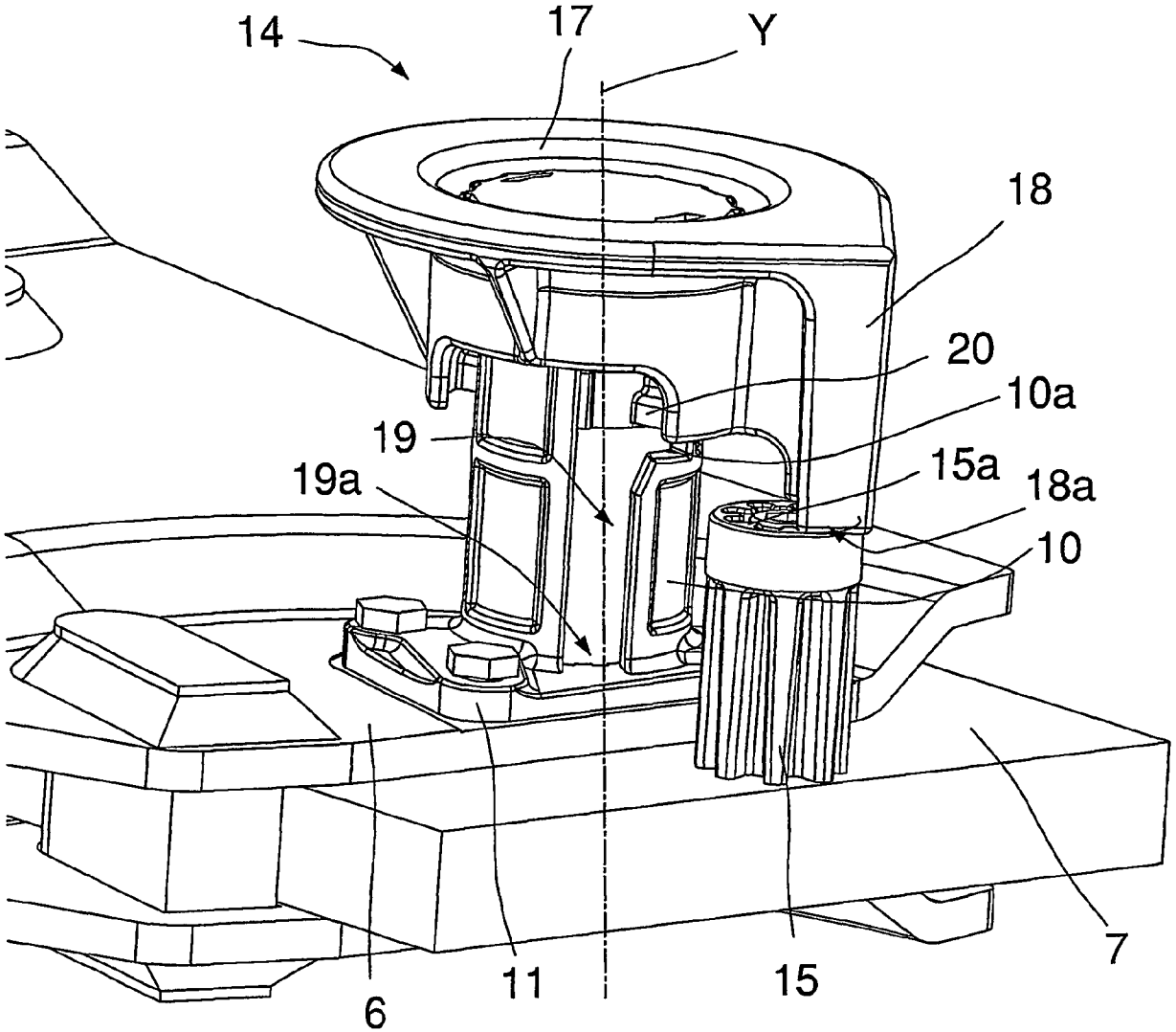
FIG. 2 shows a perspective view of part of a tractor, part of a loader and a device according to the invention in open position.
Figure 3:
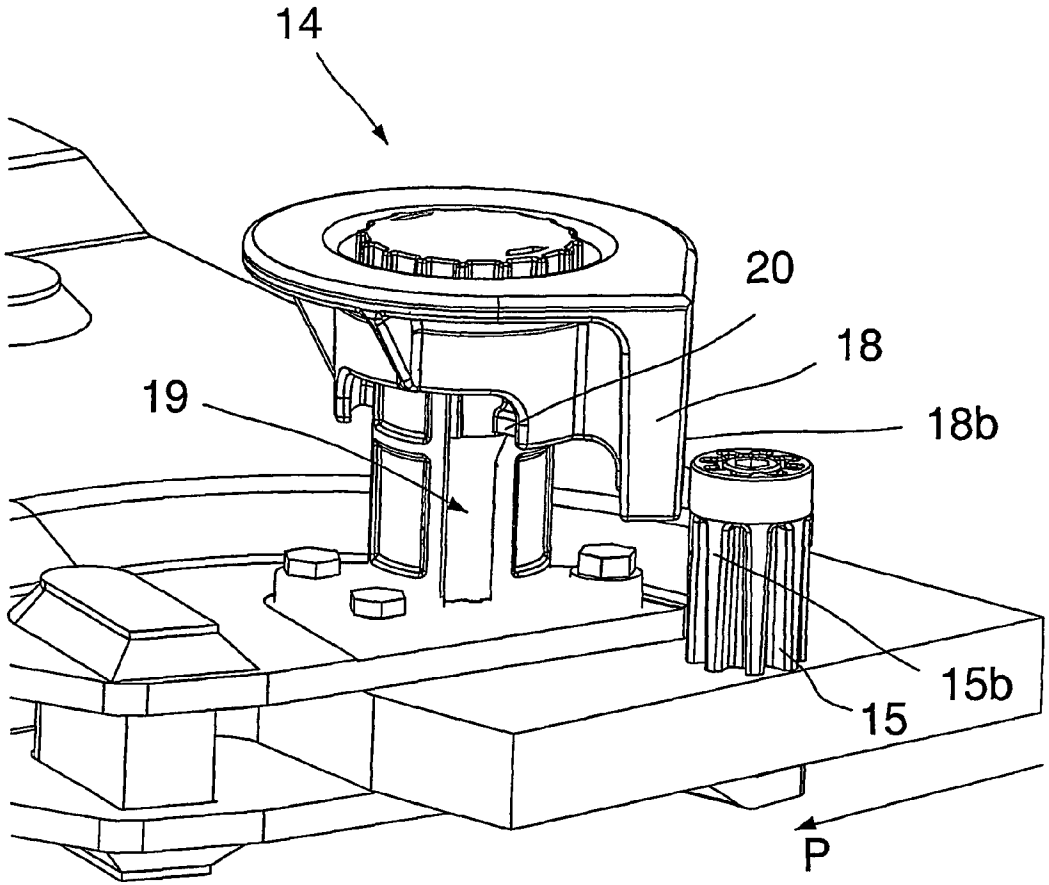
FIG. 3 shows a perspective view of part of a tractor, part of a loader and a device according to the invention in intermediate position.
Figure 4:
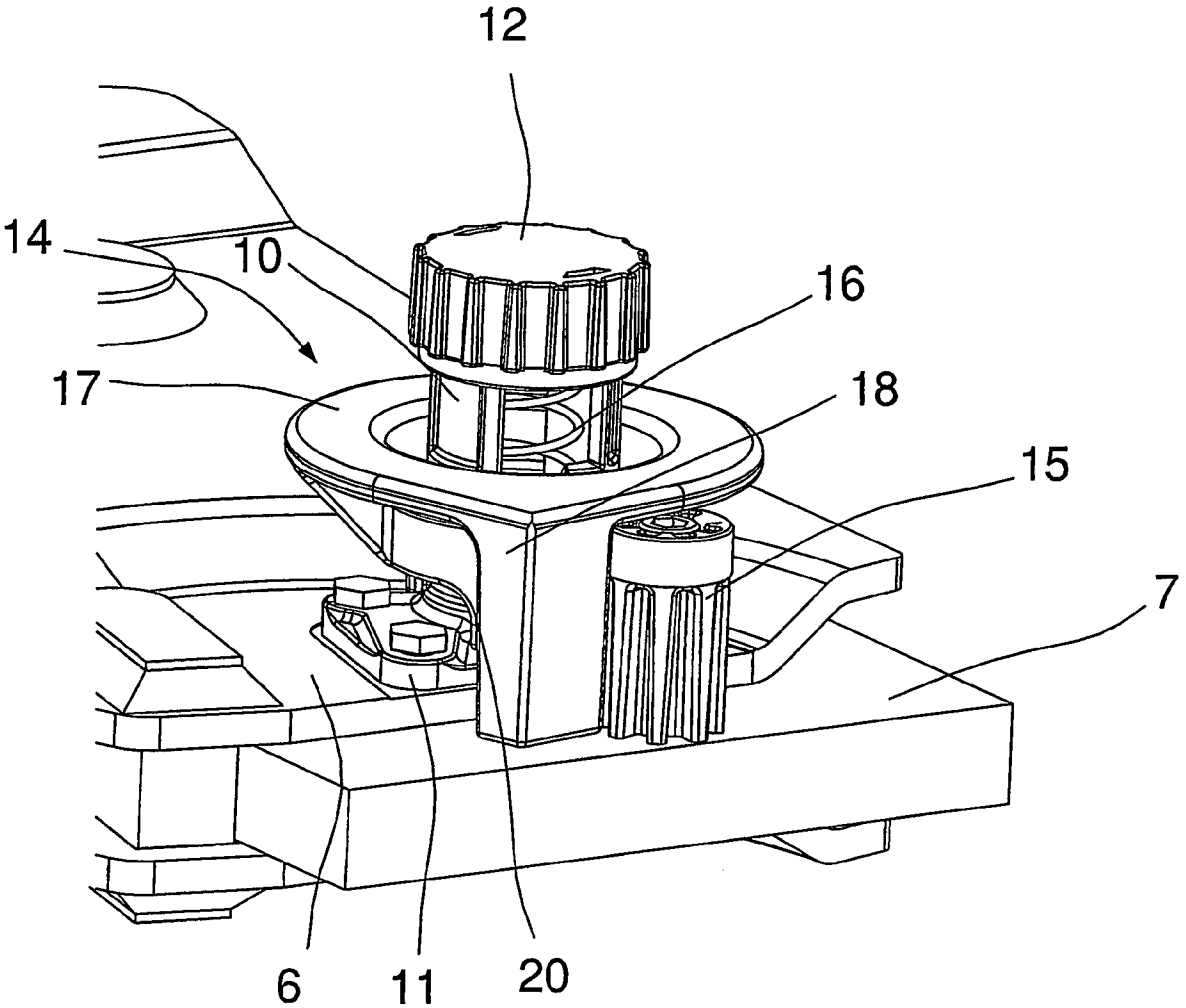
FIG. 4 shows a perspective view of part of a tractor, part of a loader and a device according to the invention in closed, locked, position.
Figure 5:
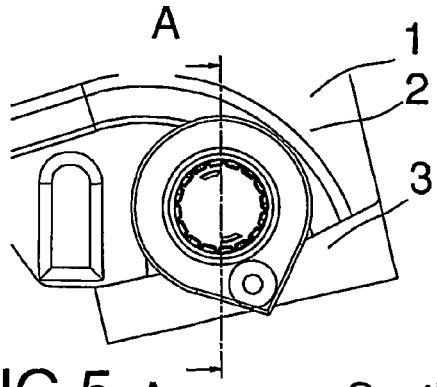
FIG. 5 shows part of a tractor, part of a loader and a device according to the invention in open position seen from the side of the tractor and loader according to FIG. 2.
Figure 6:
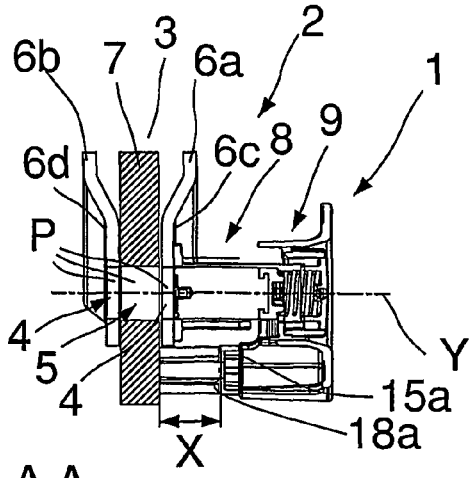
FIG. 6 shows a cross-section A-A of the device in FIG. 5.
Figure 8:
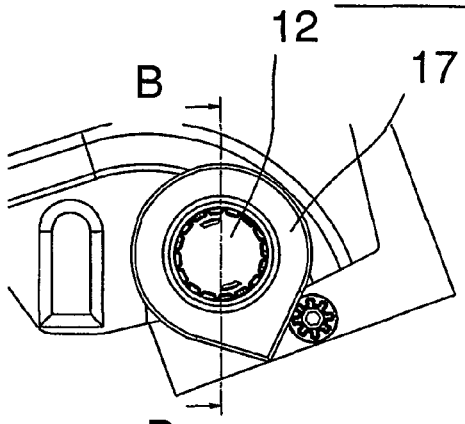
FIG. 8 shows part of a tractor, part of a loader and a device according to the invention in an intermediate position of the locking work seen from the side of the tractor and loader according to FIG. 3.

A device 1 according to the invention, see FIG. 2-4, for attaching a loader 2, see FIG. 1, to a vehicle 3 interacts with, when the loader is in its attaching position in relation to the vehicle, axial/parallel arranged openings 4 running through the loader 2 and openings 5 in the vehicle 3, refer to FIG. 6. The openings 4 and 5 are at the time of attachment arranged so that the centre point of each opening lies on an axis that is common to all the holes while also constituting the longitudinal axis Y of the device 1. The vehicle 3 is suitably a tractor but can also be another form of vehicle as long as its function and basic construction is the same.

In the loader 2, the openings 4 are made in parts 6 of the loader that are facing the tractor 3. These parts 6 will henceforth be called bearing boxes and are two in number on each loader 2. One device 1 is required for each bearing box 6. Each device 1 is controlled from the side area of the loader and tractor, right and left hand side respectively or "outside A" as this side will henceforth be called, and acts in against the loader/tractor, essentially at a straight angle to the longitudinal axis L of the vehicle 3. The side of the component parts and details of each device 1 opposite to the outside A is called "inside B". The sides of the component parts and the details that are facing outside A and inside B respectively will be named correspondingly. See FIG. 6.

The openings 5 in the tractor 3 are made in attachment parts 7 that constitute parts of a mounting (not shown in full in the figures) that is a part of the tractor 3. Also the attachment parts 7 are two in number on each tractor.

Each bearing box 6 exhibits parallel flange like parts 6*a* and 6*b* between which the respective attachment part 7 is arranged in such a way that the openings 4 and 5 are opposite each other. See FIG. 6.

The device 1 comprises a fixed part 8 mounted on, or constituting a part of, the bearing box 6, and by that is part of the loader 2. The fixed part 8 is located on the outside 6*a* of the bearing box. The device 1 also comprises a part 9 that can move in relation to the fixed part 8. The moving part 9 is moved from an open position to a locked position when a loader is being attached to a vehicle; see FIGS. 6 and 9.

When attaching the loader 2 to the tractor 3, the moving part 9 is moved from the open position, see FIGS. 2, 5, 6 and 7, where the moving part 9 in all respects is outside the bearing box 6 on side A of the bearing box/loader, to the locking position, see FIGS. 4, 8, 9 and 10. While moving to the locking position the moving part 9 is inserted into the openings 4 and 5 and thereby into the bearing box 6, into its both parts 6*a* hand 6*b*, and into the attachment part 7. When in a completely locked position, the outer part 9*a* of the moving part 9 will have passed through all the openings 4 and 5 so that it, the outer part 9*a*, will protrude from inside B, outside the inner flange part's inside 6*d* on the inside of the bearing box/loader. The tractor driver is able to see this area from inside the cab.

The motion of the moving part 9 can be discerned by the eye of the driver because the moving part 9 moves clearly in relation to the fixed part 8. This means that whether the moving part 9 is in open or locking position it is clearly visible. An automated position control can also be used. To further emphasise that the moving part 9 is correctly placed in locking position, the end part 9*a* of the locking bolt can be coloured, for example with a clearly discernable colour that deviates from the colour of the surrounding parts, preferably fluorescent to facilitate registering in the dusk/dark. This marking is made visible to the driver from the driver's cab.

The fixed, stationary part 8 covers and protects the device's moving part 9 and also controls the moving part 9 while it moves from an open position to a locking position. The moving part 9 is essentially arranged inside the fixed part 8 but, when it is in locking position, it is displaced in relation to the fixed part 8 and consequently situated partially outside the fixed part 8 towards the loader/tractor in the openings 4 and 5.

Figure 9:
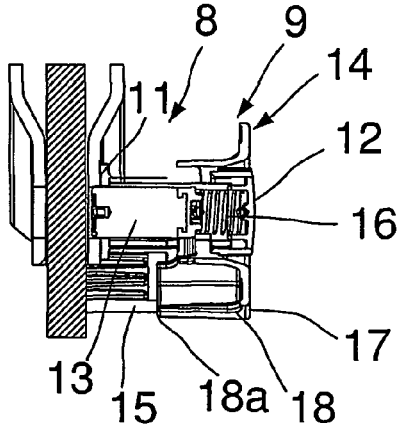
FIG. 9 shows a cross-section B-B of the device in FIG. 8.
Figure 11:
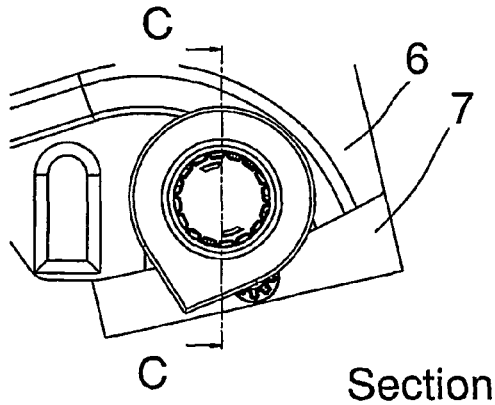
FIG. 11 shows part of a tractor, part of a loader and a device according to the invention in locked position seen from the side of the tractor and loader according to FIG. 4.

The fixed part 8 is essentially cylindrical and comprises an elongated body 10 with open inner that on its end turned towards the bearing box 6 has a supporting part 11 and on its other end, the outer end, has a top part 12, see FIGS. 4 and 9. The supporting part 11 rests against and is joined to the outside of the bearing box 6 and fixes the device 1 in a central way in relation to the parallel openings 4 and 5 in the bearing box 6 and the attachment part 7 respectively. The top part 12 acts as a fixed cover of the outer end of the fixed elongated body.

The moving part 9 comprises an elongated cylindrical locking bolt 13 arranged to slide inside the fixed part 8. The moving part 9 comprises also a guide part 14 that is permanently joined to the locking bolt 13 and with which the position of the locking bolt is controlled. The guiding part 14 is brought to interact with a blocking device 15, which blocks/locks the moving part 9 in relation to the fixed part 8 and which constitutes a part of, or is joined to, the attachment part of the tractor 7, see FIGS. 2 and 6.

Figure 12:
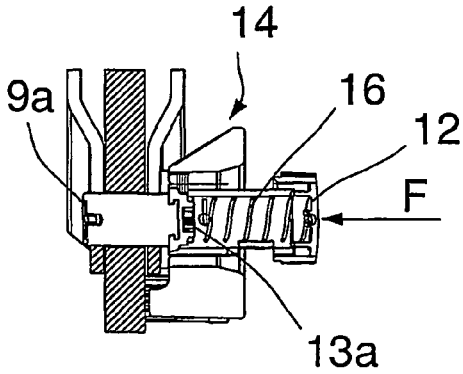
FIG. 12 shows a cross-section C-C of the device in FIG. 11.
Figure 7:
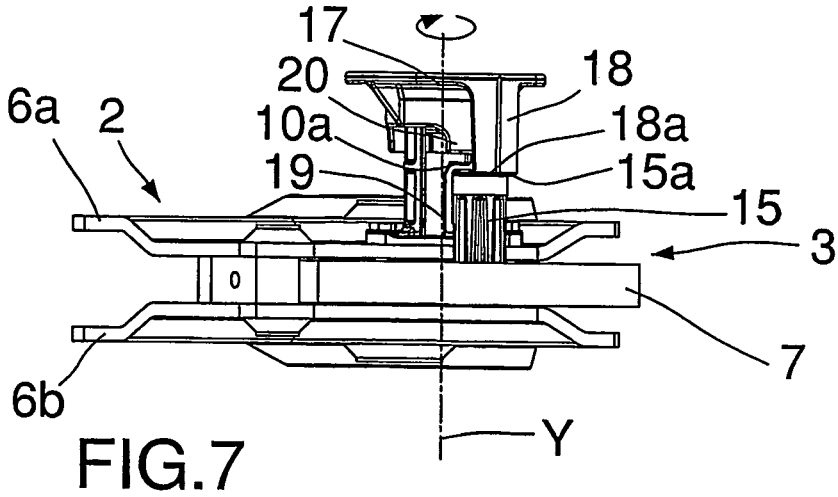
FIG. 7 shows the parts in FIG. 5 seen from above.
Figure 10:
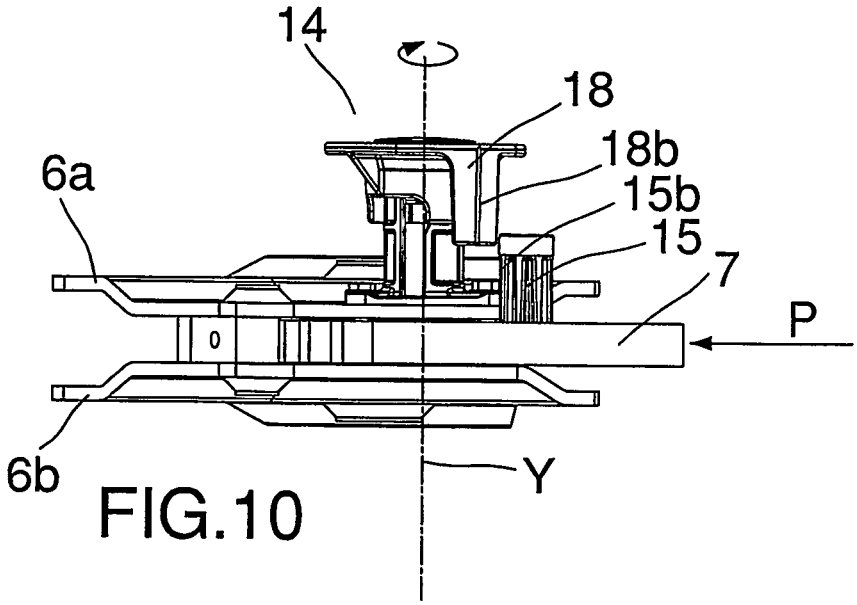
FIG. 10 shows the parts in FIG. 8 seen from above.

An influencing part 16, a spring, a compression spring, acts between the fixed part 8 and the moving part 9, see FIGS. 4, 6 and 12. The spring 16 conveys a force F, see FIG. 12, to the moving part 9 so that it strives to attain a locking position. The spring 16 is on its one end joined to the outer end 13*a* of the locking bolt 13 and at is its other end joined to the top part 12.

When the moving part 9 is in its open position, the moving part 9 is extracted from all openings 4 and 5 and is situated on the outside of the loader A. When the moving part 9 is extracted, it moves in relation to the fixed part 8, whereby the spring 16 is compressed and energy is stored in the spring 16. The guiding part 14 is then turned so that it rests against the fixed part 8. The moving part 9 has here taken an intermediate position, see FIGS. 3 and 9, where the spring 16 is tensioned and locked and where the tractor 3 can activate the device 1 so that the moving part 9 moves to its locking position. The guiding part 14 is then brought to interact with the blocking device 15, whereby the spring 16 remains in its compressed position while the motion of the moving part 9 in relation to the fixed part 8 is prevented, see FIGS. 3 and 4. When the guiding part 14 is released from its interaction with the blocking device 15 and the section 10*a*, the energy stored in the spring 16 is also released and then used to move the moving part 9 into its locking position in the openings 4 and 5, see FIGS. 4 and 13. The guiding part 14 comprises a gripping part 17 in the form of a circular flange that offers a grip and an interacting part 18 in the form of a part directed away from the gripping flange 17 towards the loader 2 in the longitudinal direction of the locking bolt, see FIG. 9.

The blocking device 15 constitutes a body with a chosen thickness X. The blocking device 15 has a limiting surface 15*a* that is directed away from the loader and that is essentially parallel to the outside of the loader 6*c*. The outer end 18*a* of the interacting part is brought to lie close to this surface 15*a* when the device 1 is in open position. See FIG. 2.

The fixed part 8 comprises a guiding component 19 in the form of a slot in the elongated body 10. The slot runs parallel to the longitudinal axis Y of the device and can receive a section 20 of the moving part 9 of the guiding part 14 for guiding the same during an axially longitudinal movement in relation to the fixed part 8 to/from a locking position. See FIG. 2.

Figure 13:
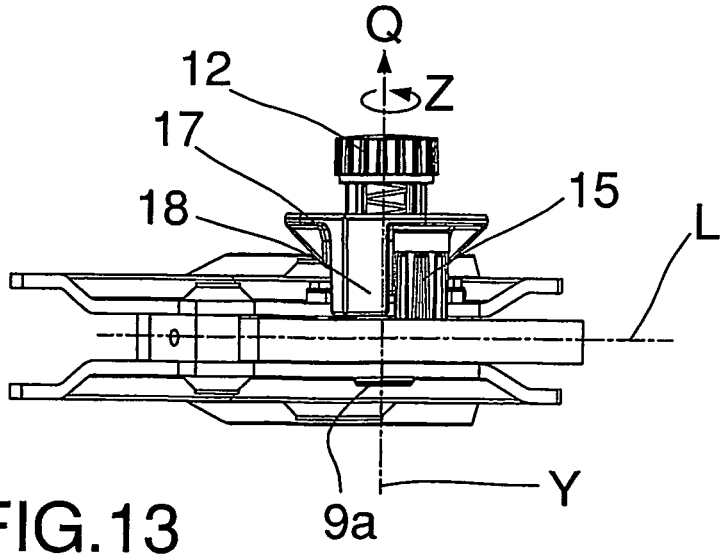
FIG. 13 shows the parts in FIG. 11 seen from above.

When extracting the moving part 9 out of the openings 4 and 5 in the longitudinal direction of the device, the moving part 9 is moved in relation to the fixed part 8 out and away from the loader/tractor, indicated with arrow Q in FIG. 13, whereby the spring 16 is compressed and energy is stored in the spring 16. An operator takes hold of and pulls the gripping flange 17, and thereby the moving part 9, in the axial direction of the device in a direction away from the loader/tractor. The moving part 9 can only be displaced in an axial direction as long as the section 20 runs in the slot 19, see FIG. 2. In a certain extracted position, the section 20 will disengage from the slot 19, whereby the moving part 9 can be turned anticlockwise, indicated with arrow Z in FIG. 13, some way around the longitudinal axis Y of the device in a direction towards the blocking device 15 to a position where the interacting part 18 with one side 18*b* parallel to the longitudinal axis Y rests against one side 15*b* of the blocking device 15 parallel to the longitudinal axis Y of the device. At the same time as the anticlockwise turning is started, the compression of the spring 16 ceases. Sections 14*a* of the guiding part 14 rest against the outside of a radially arranged section 10*a* of the fixed part 8, an outer edge section of the elongated body 10. The moving part 9 has here taken an intermediate position, see FIGS. 3 and 9, where the spring is tensioned and locked and where the tractor can activate the device 1 so that the moving part 9 moves to its locking position.

The moving part 9, the guiding part 14, can now been drawn out a further way by the operator taking hold of and pulling out the gripping flange 17, and thereby the moving part 9, in the axial direction of the device away from the loader/tractor so that the interacting part 18 comes outside the blocking device 15. The thickness X of the blocking device is chosen so that the locking bolt in this position is fully extracted outside the bearing box 6*a*. The moving part 9, the guiding part 14, can now be turned a further way anticlockwise and thereby be brought into interaction with the blocking device 15, whereby the spring 16 is maintained in its compressed position at the same time as all the motion of the moving part 9 in relation to the fixed part 8 is prevented and where a tractor 1 cannot activate the device, see FIGS. 4 and 12.

The previously known design with one locking pin requires manual insertion, which above all is time consuming. The device 1 according to the present invention as previously stated offers an intermediate position where the device 1 can be activated with the help of the tractor 3. When the loader 2 is to be attached to the tractor 3 with the device 1 in intermediate position, the tractor's attachment part 7 with blocking device 15 is inserted between the flange-like parts 6*a* and 6*b* and subsequently moved, see device illustrated in FIGS. 3, 9 and 10, to the right, see arrow P, whereby the blocking device 15 will push the guiding part 14, the influencing part 18, since the interacting part 18 is resting against the blocking device 15 so that it turns clockwise until the section 20 is in front of the slot 19. When the moving part 9 is in this position, the energy stored in the spring 16 is released and is then used to move the moving part 9 into the openings 4 and 5 to its locking position, see FIGS. 4, 12 and 13. The moving parts axial movement is controlled by the slot 19. The locking of the device 1 arranged in this intermediate position consequently takes place without any manual intervention, which makes the attaching procedure faster and more precise. The turning motion performed with the help of the tractor 3 can also be done manually using the guiding part 14.

By moving the moving part 9 in the axially longitudinal direction away from the loader/tractor combined with a turning motion of the moving part 9 around the longitudinal axis Y, the interacting part 18 is moved to a terminal position where it will interact with the surface 15*a* of the blocking device. An operator takes hold of and pulls the gripping flange 17, and thereby the moving part 9, in the axial direction of the device in a direction away from the loader/tractor so that the interacting part 18 comes outside of the blocking device 15. The thickness X of the blocking device is chosen so that the locking bolt in this position is fully extracted outside the bearing box 6*a*. Subsequently, or strictly speaking in the same movement, the operator turns the gripping flange 17 so that the interacting part 18 comes in over the blocking device 15. When the operator releases the gripping flange 17, the spring 16 will press the outer end of the interacting part 18*a* against the surface 15*a* of the blocking device, whereby further motion is prevented.

This description is not to be regarded as a limitation of the invention but as an example to facilitate comprehension of the invention in all its parts. It should also be understood that other embodiments than the ones described above and illustrated in the figures are possible within the framework of the idea of invention specified in the following claims.

The invention claimed is:

1. A device for attaching a loader to a vehicle, wherein the loader comprises openings in parts facing towards the vehicle and the vehicle comprises openings in attaching parts facing the loader, and wherein the openings when attaching the loader to the vehicle are arranged so that the centre points of the openings lie on an axis common to all the openings, the device comprising:

a fixed part arrangeable on the outside of the loader, a moving part that is supported inside the fixed part and can move in relation to the fixed part and which is protected, controlled and directed by the fixed part, and a biasing member connected at a first end to the moving part and at a second end to the fixed part to convey a force to the moving part so that the moving part moves toward a locking position, wherein the moving part when attaching the loader to the vehicle is turned from an open position where there is no locking action between the loader and the vehicle to an intermediate position where the biasing member is tensioned and locked and the moving part can be engaged by the vehicle, whereby the biasing member is unlocked by the engagement of the vehicle and the moving part to convey the force and the moving part is moved further to the locking position at which the moving part is inserted in the openings and through interaction with the openings locks the biasing member the loader to the vehicle and is kept in the locking position by the force from the biasing member.

2. Device according to claim 1 where the fixed part is essentially cylindrical and comprises an elongated body with an open inner portion.

3. Device according to claim 2 wherein the elongated body on its end positionable to face the loader comprises a supporting part that is connectable to the outside of the loader and which is arranged to fix the centre of the device in relation to the openings.

4. Device according to claim 2 wherein the elongated body on its outer end has a top part that constitutes a cover on the outer end of the fixed part.

5. Device according to claim 1 wherein the moving part comprises an elongated cylindrical locking bolt arranged to slide in relation to the fixed part.

6. Device according to claim 5 wherein the moving part comprises a guiding part that controls the position of the locking bolt.

7. Device according to claim 6, wherein the guiding part is fixed to the locking bolt.

8. Device according to claim 6 wherein the guiding part comprises a gripping part in the form of a circular flange that offers a grip and an interacting part in the form of a part extending from the gripping flange and towards the loader in the longitudinal direction of the locking bolt.

9. Device according to claim 1, further comprising a blocking device to block or lock the moving part in relation to the fixed part when the moving part is in its open position.

10. Device according to claim 9, where the blocking device interacts with a guiding part of the moving part to block or lock the moving part in relation to the fixed part.

11. Device according to claim 10 where the blocking device has a limiting surface that is essentially parallel to an outside of the loader and to which an outer end of an interacting part of the moving part is brought to rest when the movable part is in the open position.

12. Device according to claim 10 where the blocking device is part of or joined to the vehicle.

13. Device according to claim 1 wherein the biasing member is a spring that acts between the fixed part and the moving part.

14. Device according to claim 13 where the spring is a compression spring that at one end is joined to the outer end of a locking bolt of the moving part and at its other end is joined to a top part of the fixed part.

15. Device according to claim 1 wherein the fixed part includes an elongated body having a guiding component that receives a section of the moving part and which guides the moving part during longitudinal movement to/from the locking position and further comprises a radially arranged section that also interacts with the section of the moving part and which guides the turning of the moving part around the longitudinal axis of the device in the intermediate position.

16. Device according to claim 15 wherein the guiding component is a slot running parallel to the longitudinal axis of the device.

17. Device according to claim 15 wherein the radially arranged section is an outer edge of the elongated body.

18. A loader, a vehicle and the device of claim 1 to attach the loader to the vehicle.

* * * * *